US012742124B2

(12) United States Patent
Mastalir

(10) Patent No.: US 12,742,124 B2
(45) Date of Patent: Sep. 22, 2026

(54) METHOD FOR PRODUCING A HYDROCARBON PRODUCT

(71) Applicant: OMV DOWNSTREAM GMBH, Vienna (AT)

(72) Inventor: Matthias Mastalir, Vienna (AT)

(73) Assignee: OMV DOWNSTREAM GMBH, Vienna (AT)

( * ) Notice: Subject to any disclaimer, the term of this patent is extended or adjusted under 35 U.S.C. 154(b) by 239 days.

(21) Appl. No.: 18/698,938

(22) PCT Filed: Oct. 20, 2022

(86) PCT No.: PCT/EP2022/079152

§ 371 (c)(1),
(2) Date: Apr. 5, 2024

(87) PCT Pub. No.: WO2023/067035

PCT Pub. Date: Apr. 27, 2023

(65) Prior Publication Data

US 2024/0400916 A1 Dec. 5, 2024

(30) Foreign Application Priority Data

Oct. 20, 2021 (EP) ..... 21203750

(51) Int. Cl.
*C10G 55/04* (2006.01)
*C10G 29/20* (2006.01)

(52) U.S. Cl.
CPC ..... *C10G 55/04* (2013.01); *C10G 29/20* (2013.01); *C10G 2300/1003* (2013.01)

(58) Field of Classification Search
CPC ..... C10K 1/003; C10K 1/121; C10G 29/20; C10G 1/10; C10G 55/04; C10G 2300/201; C10G 2300/1003; C10G 2300/80
See application file for complete search history.

(56) References Cited

U.S. PATENT DOCUMENTS 6,060,631 A 5/2000 James, Jr.
6,329,496 B1 12/2001 Komaki

FOREIGN PATENT DOCUMENTS

CN 1317040 A 10/2001
CN 103484155 B 6/2015
CN 105001910 B 9/2016
(Continued)

OTHER PUBLICATIONS

International Search Report dated Feb. 16, 2023 issued in PCT International Patent Application No. PCT/EP2022/079152, 6 pp.
(Continued)

*Primary Examiner* — Vishal V Vasisth
(74) *Attorney, Agent, or Firm* — NIXON & VANDERHYE P.C.

(57) ABSTRACT

A method for producing a hydrocarbon product from a hydrocarbon mixture containing at least 1 ppm of organically bound halogen includes providing the hydrocarbon mixture containing at least 1 ppm of organically bound halogen, heating the hydrocarbon mixture in order to obtain a gaseous hydrocarbon stream, bringing the gaseous hydrocarbon stream into contact with a composition containing at least one nitrogen compound in order to obtain a gaseous mixture, as a result of which organically bound halogen is converted into halide ions, and separating the halide ions in order to obtain the hydrocarbon product.

16 Claims, 1 Drawing Sheet

(56) References Cited

FOREIGN PATENT DOCUMENTS

| | | | |
|---|---|---|---|
| CN | 112283712 | B | 7/2021 |
| WO | 98/02402 | | 1/1998 |
| WO | 2012149590 | A1 | 11/2012 |
| WO | 2020254634 | A1 | 12/2020 |
| WO | 2021204817 | A1 | 10/2021 |

OTHER PUBLICATIONS

Hinz B. et al., "Dehalogenation of pyrolysis products," Journal of analytical and applied pyrolysis, Amsterdam, Jan. 1, 1994 (Jan. 1, 1994), pp. 35-46, Retrieved from the Internet: https :/ /www researchgate.net/publication/229288424_Dehalogenation_of_pyrolysis_products [retrieved on Mar. 20, 2022] DOI: 10.1016/0165-2370(94)00800-0 XP055907103.

Brebu et al. "Effect of flame retardants and Sb"2O"3 synergist on the thermal decomposition of high-impact polystyrene and on its debromination by ammonia treatment" Journal of Analytical and Applied Pyrolysis, Elsevier BV, NL, vol. 79, No. 1-2, Apr. 19, 2007 (Apr. 19, 2007), pp. 346-352 DOI: 10.1016/J.JAAP.2007.02.003 ISSN: 0165-2370, XP022062380.

European Search Report dated Apr. 8, 2022 issued in European Patent Application No. 21203750.1, 37 pp.

Chinese Search Report dated Dec. 19, 2025 issued in Chinese Patent Application No. 2022800660733 and English translation, 6 pp.

United Arab Emirates Office Action dated Aug. 21, 2025 issued in United Arab Emirates Patent Application No. P2024-00993, 6 pp.

English translation of International Preliminary Report on Patentability dated Apr. 25, 2024 issued in PCT International Patent Application No. PCT/EP2022/079152, 10 pp.

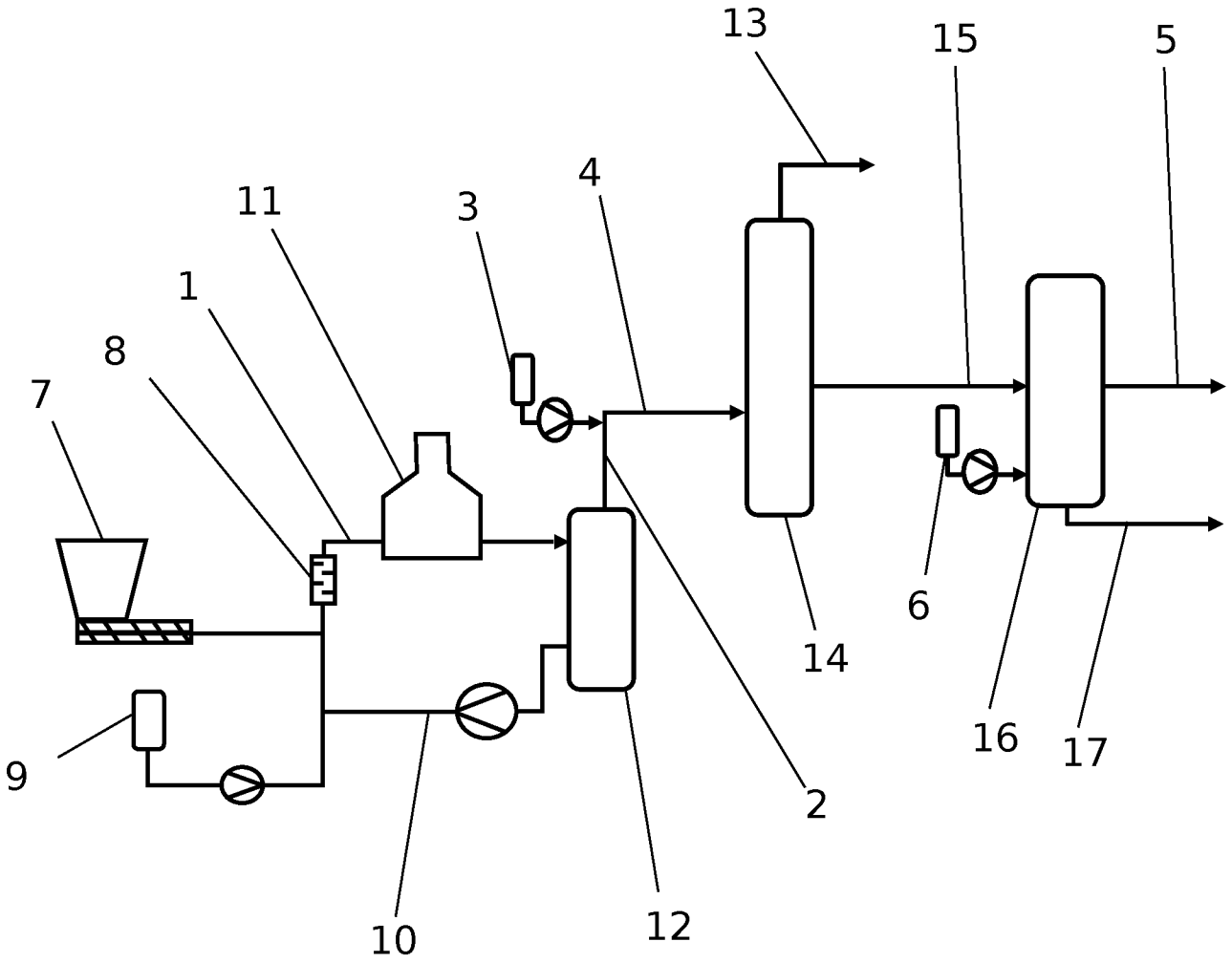
5
15
13
4
3
11
1
8
7
17
16
6
14
2
12
10
9

METHOD FOR PRODUCING A HYDROCARBON PRODUCT

This application is the U.S. national phase of International Application No. PCT/EP2022/079152 filed Oct. 20, 2022 which designated the U.S. and claims priority to European Patent Application No. 21203750.1 filed Oct. 20, 2021, the entire contents of each of which are hereby incorporated by reference.

The present invention relates to a method for producing a hydrocarbon product from a hydrocarbon mixture, preferably containing at least 1 ppm of organically bound halogen.

Impurities with organic halogen compounds pose a problem in many refining processes. For example, this relates to the production of synthetic crude oils from the pyrolysis of plastic material or other raw materials. Plastic mixtures often contain halogenated polymers, for example polyvinyl chloride (PVC), polytetrafluoroethylene (PTFE) or even halogenated flame retardants, which enter the process in pyrolysis methods and can be found in the respective products in the form of organic halogen compounds. As a result, the product quality is reduced significantly. The same applies to other refinery processes, for example fossil crude oils or crude oil products are often contaminated with considerable amounts of organic halogen compounds.

Organically bound halogen can be partially removed at high temperatures by β-elimination. For example, the pyrolysis of plastic mixtures containing PVC can lead to the partial elimination of hydrogen chloride with cleavage of the organic carbon-chlorine bonds. However, these reactions are often incomplete and organic chlorine compounds remain in large quantities.

The methods known from the prior art generally address this problem by specifying low organohalogen tolerances for the starting materials, for example in combination with elaborate pre-selection of the starting materials, and/or by intensive after-treatment of the products obtained, for example by hydrogenation.

However, this leads to less flexible, less efficient and less economical processes.

Hinz et al. (Journal of Analytical and Applied Pyrolysis 30.1 (1994): 35-46) describe methods for the dehalogenation of pyrolysis products. Brebu et al. (Journal of Analytical and Applied Pyrolysis 79.1-2 (2007): 346-352) describe methods for the thermic decomposition of high impact polystyrene. Further methods are known from CN 105 001 910 B, U.S. Pat. No. 6,329,496 B1 and CN 112 283 712 B.

Therefore, there is a need for new or improved methods for producing hydrocarbon products, for example, synthetic crude oils or crude oil products. It is an object of the present invention to make such methods available. In particular, it is an object of the invention to provide methods which permit the use of hydrocarbon mixtures containing large amounts of organically bound halogen or which enable a reduction in the content of organically bound halogen in the hydrocarbon product.

According to the invention, this object is solved by a method for producing a hydrocarbon product from a hydrocarbon mixture preferably containing at least 1 ppm of organically bound halogen, the method comprising the following steps:

- providing the hydrocarbon mixture, preferably containing at least 1 ppm of organically bound halogen;
- heating the hydrocarbon mixture in order to obtain a gaseous hydrocarbon stream;
- bringing the gaseous hydrocarbon stream into contact with a composition containing at least one nitrogen compound in order to obtain a gaseous mixture, as a result of which organically bound halogen is converted into halide ions; and
- separating the halide ions in order to obtain the hydrocarbon product.

In the course of the present invention, it has surprisingly been found that the content of organically bound halogen in the hydrocarbon product can be considerably reduced if, during production, a hydrocarbon stream obtained from the starting material is brought into contact with nitrogen compounds in the gas phase. The added nitrogen compounds can enter into nucleophilic substitution reactions with the organic halogen compounds and thus cleave the carbon-halogen bonds. As a result, organically bound halogen is converted into halide ions, which can subsequently be simply separated, for example by washing with an aqueous solution or by distillation. Carrying out the substitution reactions in the gas phase has the advantage, on the one hand, that the hydrocarbon stream is mixed particularly well with the nitrogen compounds and, on the other hand, that the substitution reactions take place particularly efficiently and a short reaction time is made possible. The method according to the invention thus makes it possible to use hydrocarbon mixtures with a high content of organically bound halogen as starting material and at the same time to obtain hydrocarbon products with a low content of organically bound halogen.

In connection with the invention, "organically bound halogen" preferably means halogens which are present in chemical compounds bound to carbon. Preferably, the content of organically bound halogen is determined according to DIN EN 14077:2004-03. Alternatively, the content of organically bound halogen can also be determined according to DIN EN 14582:2016-12. In connection with the invention, the standard ASTM D7359:2014 07 01 is also suitable for the determination of organically bound halogen, in particular organically bound fluorine and/or chlorine.

In preferred embodiments, the organically bound halogen is selected from organically bound fluorine, chlorine, bromine, iodine, or mixtures thereof; more preferably, chlorine, bromine, iodine, or mixtures thereof; most preferably, chlorine. The method according to the invention has proven to be particularly suitable for the removal of organic chlorine compounds.

The hydrocarbon mixture preferably contains at least 1 ppm, preferably at least 10 ppm, even more preferably at least 100 ppm, even more preferably at least 1,000 ppm, even more preferably at least 2,000 ppm, even more preferably at least 5,000 ppm, even more preferably at least 10,000 ppm, most preferably at least 15,000 ppm of organically bound halogen, in particular organically bound chlorine. The hydrocarbon mixture preferably contains from 1 ppm to 70,000 ppm, preferably from 10 ppm to 65,000 ppm, more preferably from 100 ppm to 60,000 ppm, even more preferably from 1,000 ppm to 50,000 ppm, even more preferably from 2,000 ppm to 40,000 ppm, even more preferably from 5,000 ppm to 30,000 ppm, most preferably from 10,000 to 20,000 ppm of organically bound halogen, in particular organically bound chlorine.

In connection with the method according to the invention, the hydrocarbon mixture preferably contains halocarbons, preferably selected from haloalkanes, haloalkenes, aromatic halocarbons and/or mixtures thereof. It is particularly preferred, if the hydrocarbon mixture contains halogenated polymers, in particular PVC and/or PTFE.

PVC may be present in different starting materials for refining processes. PVC plays an important role, for example, in the production of synthetic crude oil through the pyrolysis of plastic material, in particular waste plastics. During the pyrolysis process, some of the carbon-chlorine bonds can be cleaved by β-elimination, but these reactions are generally not complete and chlorine-containing alkenes can be found in the products. In order to keep the content of organically bound chlorine in the pyrolysis oil low, the proportion of PVC in the starting material must often be limited to lower values. In the course of the invention, it has been found that it is precisely the chlorine-containing alkenes, which are formed as PVC degradation products in the pyrolysis process, that can be converted particularly efficiently in substitution reactions with the nitrogen compounds used. As a result, the method according to the invention makes it possible to use hydrocarbon mixtures with a high PVC content. As a result, for example, plastic mixtures from the recycling of electronic waste can be used, which typically contain high proportions of organochlorine and organobromine, in particular PVC from cables, but also flame retardants such as hexabromocyclododecane (HBCD), or chlorinated paraffins. In a preferred embodiment, the hydrocarbon mixture therefore contains PVC, preferably at least 0.001 wt %, more preferably at least 0.01 wt %, more preferably at least 0.1 wt %, even more preferably at least 0.2 wt %, even more preferably at least 0.3 wt %, even more preferably at least 0.4 wt %, even more preferably at least 0.5 wt %, even more preferably at least 0.6 wt %, even more preferably at least 0.7 wt %, even more preferably at least 0.8 wt %, even more preferably at least 0.9 wt %, most preferably at least 1 wt % PVC. The hydrocarbon mixture preferably contains from 0.001 to 10 wt %, preferably from 0.01 to 8 wt %, more preferably from 0.1 to 7.0 wt %, even more preferably from 0.2 to 6.5 wt %, even more preferably from 0.3 to 6.0 wt %, even more preferably from 0.4 to 5.5 wt %, even more preferably from 0.5 to 5.0 wt % of PVC.

Another source of organic halogen compounds that can cause problems in refining processes are halogen-containing flame retardants. For example, waste plastics and other plastic mixtures often contain considerable amounts of such flame retardants, which are subsequently found as organic halogen compounds in the pyrolysis oils obtained from the plastic mixtures. Bromine-containing flame retardants, for example decabromodiphenyl ether (DecaBDE), which is added inter alia in considerable amounts to polyamides and polyolefins, or tetrabromobisphenol A (TBBPA), which is added inter alia to polyesters, or hexabromocyclododecane (HBCD), which is used, for example, in insulation foams, e.g. EPS (expanded polystyrene) and XPS (extruded polystyrene), are particularly widespread in this context. The method according to the invention has also proven to be particularly suitable for removing organically bound halogen from halogen-containing flame retardants, in particular from organically bound bromine. In another preferred embodiment the hydrocarbon mixture therefore contains halogen-containing, preferably bromine-containing flame retardants, preferably polybrominated diphenyl ethers and/or polybrominated biphenyls, more preferably decabromodiphenyl ether (DecaBDE), tetrabromobisphenol A (TBBPA) and/or hexabromocyclododecane (HBCD). It is particularly preferred, if the hydrocarbon mixture contains at least 1 ppm, preferably at least 10 ppm, even more preferably at least 50 ppm, even more preferably at least 200 ppm, most preferably at least 1,000 ppm of organically bound bromine, preferably in the form of bromine-containing flame retardants.

The present invention has proven to be particularly advantageous in connection with the production of synthetic crude oil. Synthetic crude oil, sometimes also referred to as syncrude, can be obtained from different processes, for example from the pyrolysis of plastic material or from biomass, for example wood. Preferably, the hydrocarbon product is therefore a synthetic crude oil or a fraction thereof.

In a preferred embodiment, the hydrocarbon mixture is a hydrocarbon mixture obtained from plastic material, in particular waste plastic. Particularly preferably, the hydrocarbon mixture is a plastic melt. The method according to the invention allows the use of plastic material with a high proportion of organic halogen compounds and thus enables the use of plastic fractions that cannot be used in other recycling processes, for example fractions with a high PVC content or plastics from electronic waste.

In another preferred embodiment, the hydrocarbon mixture is a crude oil, preferably a fossil crude oil or a synthetic crude oil, in particular a pyrolysis oil. For example, it may be a stream of crude oil contaminated by halogenated solvents.

In connection with the method according to the invention, it is preferable if the heating of the hydrocarbon mixture takes place in the course of a pyrolysis process, a hydrogenation process, or a distillation process. This has the advantage that existing processes can be used to obtain the gaseous hydrocarbon stream. Existing processes can be economically supplemented with the metering of nitrogen compounds into the gas stream in order to reduce the content of organically bound halogen in the product. For example, it is preferred for the gaseous hydrocarbon stream to be the product stream of a thermal gasoil unit (TGU) or a fluid catalytic cracking (FCC) plant. It is particularly preferred if the heating of the hydrocarbon mixture takes place in the course of a pyrolysis process, preferably the pyrolysis of plastic material, for example as known from WO 2012/149590 A1 or U.S. Pat. No. 6,060,631 A.

Preferably, the hydrocarbon mixture is heated to a temperature of at least 150° C., preferably at least 200° C., more preferably at least 250° C., even more preferably at least 300° C., even more preferably at least 350° C., most preferably at least 400° C., in order to obtain a gaseous hydrocarbon stream. By such high temperatures, some of the hydrocarbon-halogen bonds can already be cleaved by elimination reactions before being brought into contact with the nitrogen compounds, which overall leads to an even more efficient reduction in the content of organically bound halogen.

In a preferred embodiment, the temperature of the gaseous hydrocarbon stream when brought into contact with the composition containing the at least one nitrogen compound is at least 150° C., preferably at least 200° C., more preferably at least 250° C., even more preferably at least 300° C., most preferably at least 350° C. Preferably, the temperature is between 150° C. and 550° C., preferably between 200° C. and 500° C., more preferably between 200° C. and 480° C., even more preferably between 250° C. and 460° C., even more preferably between 300° C. and 450° C. The metering of the composition into such a hot gaseous hydrocarbon stream enables particularly good mixing, since the composition evaporates more quickly when brought into contact and thus mixes better with the hydrocarbon stream. This in turn leads to a more efficient course of the substitution reactions and thus to a more efficient removal of organically bound halogen.

It has also proven advantageous if the temperature of the gaseous mixture obtained is at least 150° C., preferably at least 200° C., more preferably at least 250° C., even more preferably at least 300° C., most preferably at least 350° C. Preferably, the temperature is between 150° C. and 550° C., preferably between 200° C. and 500° C., more preferably between 200° C. and 480° C., even more preferably between 250° C. and 460° C., even more preferably between 300° C. and 450° C. A high temperature of the gaseous mixture favours the course of nucleophilic substitution reactions. This has proven to be particularly advantageous in the removal of organic chlorine compounds as they are less reactive than organic bromine or iodine compounds.

In the method according to the invention, the nitrogen compounds can be metered in essentially in pure form, i.e. the composition can consist essentially of one or more nitrogen compounds. However, it has proven particularly advantageous if the composition containing the at least one nitrogen compound is an aqueous composition. Surprisingly, as a result, an even more efficient removal of organically bound halogen can be achieved. In the opinion of the inventors, without being bound to a theory, this is due, on the one hand, to the fact that the presence of water can promote nucleophilic substitution reactions and, on the other hand, to the fact that the water can evaporate rapidly when brought into contact with the gaseous hydrocarbon stream and lead to a better mixing of hydrocarbon stream and nitrogen compounds.

In this context, it has proven particularly favourable if the concentration of nitrogen compounds in the composition, preferably the aqueous composition, is between 5 and 80 wt %, preferably between 7 and 70 wt %, even more preferably between 10 and 50 wt %. A concentration in this range enables an efficient course of the substitution reactions. If the composition is an aqueous composition, there is also a ratio between nitrogen compounds and the water in this range that is favourable for the course of the nucleophilic substitution reactions.

The mass ratio between the gaseous hydrocarbon stream and the composition containing the at least one nitrogen compound is preferably at least 5:1, preferably at least 10:1, even more preferably at least 20:1, even more preferably at least 50:1, even more preferably at least 100:1, even more preferably at least 150:1. Preferably, the mass ratio is between 5:1 and 250:1, preferably between 10:1 and 200:1, even more preferably between 20:1 and 150:1, most preferably between 40:1 and 100:1. It has been shown that with such a mass ratio, there is a sufficient amount of nitrogen compounds to ensure an efficient course of the substitution reactions, but at the same time the hydrocarbon stream is not diluted too much, so that the method can nevertheless be carried out particularly economically.

The at least one nitrogen compound contained in the composition is preferably a nucleophilic nitrogen compound. Preferably, the nitrogen compound is selected from the group consisting of primary amines, secondary amines, tertiary amines, ammonia and hydrazine. Preferably, the nitrogen compound is selected from the group consisting of diethanolamine, morpholine, dimethylamine, diethylamine, dipropylamine, diisopropylamine, ethylisopropylamine, piperidine, pyrrolidine, piperazine, ethanolamine, 2-methoxethylamine, 3-methoxypropylamine, methylamine, ethylamine, propylamine, isopropylamine, butylamine, hexylamine, cyclohexylamine, decylamine, diaminoethane, diaminopropane, diaminobutane, diaminohexane, diaminocyclohexane, ammonia, hydrazine, trimethylamine, triethylamine, triethanolamine and tripropylamine. Ammonia, ethanolamine, 3-methoxypropylamine, dimethylamine, diethylamine, dibutylamine, morpholine, diethanolamine, and/or triethylamine are particularly preferred in the context of the invention. In a preferred embodiment, the composition may also comprise mixtures of a plurality of different nitrogen compounds.

In the context of the experiments carried out in connection with the present invention, it has been found that particularly good results can be achieved with certain types of nitrogen compounds. Thus, on the one hand, it has proven favourable if the nitrogen compound is a primary or a secondary amine, in particular a secondary amine. On the other hand, good results were achieved in particular with volatile amines. In the opinion of the inventors, without being bound to a theory, this can be explained by the fact that volatile amines allow a faster transition into the gas phase and thus a better mixing with the hydrocarbon stream and that the high nucleophilicity of secondary amines leads to a faster course of the substitution reactions. Preferably, therefore, the at least one nitrogen compound is a secondary amine. Independently, it is preferred if the nitrogen compound has a boiling point of less than 260° C., preferably less than 200° C., even more preferably less than 150° C., in particular less than 130° C. It is particularly preferred if the at least one nitrogen compound is a secondary amine with a boiling point of less than 260° C., preferably less than 200° C., even more preferably less than 150° C., in particular less than 130° C. Nitrogen compounds that have proven particularly suitable in connection with the invention are volatile secondary amines, preferably dimethylamine, diethylamine, dibutylamine and morpholine, in particular morpholine. Mixtures of primary amines, for example ethanolamine, with volatile secondary amines have also proven to be very suitable.

In the context of the method according to the invention, separating the halide ions can preferably take place by washing with an aqueous washing solution. Due to their water solubility, halide ions or salts formed therefrom, e.g. amine hydrochlorides, can pass into the water phase and be separated therefrom. The washing can be carried out in a mechanical mixer, in a static mixer and/or in a mixer-settler, for example. Mixer-settlers have proven to be particularly suitable in this context, since the mixing of the oil phase and aqueous washing solution as well as the subsequent settling process for segregating the phases and separating the purified oil phase can take place in a continuous process. In this context, it is particularly preferred if the aqueous washing solution is a basic aqueous washing solution, preferably wherein the pH value of the aqueous washing solution is at least 7.5, preferably at least 8, even more preferably at least 9, even more preferably at least 10, even more preferably at least 12, most preferably at least 13.

In another embodiment, separating the halide ions takes place by distillation. This enables a particularly simple and at the same time thorough removal of the halide ions, since salts of the halide ions can easily deposit in the bottom of the distillation.

The method according to the invention makes it possible to obtain hydrocarbon products with a particularly low content of organically bound halogen. Preferably, the hydrocarbon product contains less than 200 ppm, preferably less than 150 ppm, even more preferably less than 100 ppm, even more preferably less than 75 ppm, even more preferably less than 50 ppm, even more preferably less than 30 ppm, even more preferably less than 20 ppm, even more preferably less than 10 ppm, most preferably less than 5 ppm of organically bound halogen, preferably organically bound halogen according to DIN EN 14077:2004-03. It is particularly preferred if the hydrocarbon product contains less than 200 ppm, preferably less than 150 ppm, even more preferably less than 100 ppm, even more preferably less than 75 ppm, even more preferably less than 50 ppm, even more preferably less than 30 ppm, even more preferably less than 20 ppm, even more preferably less than 10 ppm, most preferably less than 5 ppm of organically bound chlorine. The determination of organically bound halogen or organically bound chlorine is preferably carried out according to DIN EN 14077:2004-03 or according to ASTM D7359: 20140701.

All parameters mentioned herein refer, unless otherwise indicated, to SATP conditions according to IUPAC ("Standard Ambient Temperature and Pressure"), in particular to a temperature of 25° C. and a pressure of 101,300 Pa.

All percentages (%) herein refer, unless otherwise indicated, to percent by weight.

Information in "ppm" herein refers, unless otherwise indicated, to parts per million on a mass basis (ppmw). 1 ppm as used herein corresponds to 0.0001 wt %.

The present invention is illustrated by the following FIGURE and the following examples, to which, of course, it is not limited.

FIG. 1 shows a method flow diagram of a preferred embodiment of the method according to the invention.

In the embodiment shown in FIG. 1, the hydrocarbon mixture 1 is a melt obtained from plastic material, preferably containing 0.1 to 5 wt % of PVC. The plastic material is compacted, degassed and melted in an extruder 7. The plastic melt exiting the extruder 7 is mixed in a static mixer 8 with an external solvent 9, preferably heavy fuel oil, and/or with already pyrolised plastic material, which is recirculated as recycling stream 10, in order to reduce the viscosity of the plastic melt. The hydrocarbon mixture 1 thus obtained is heated in a depolymerisation reactor 11, preferably to a temperature between 400° C. and 440° C., resulting in depolymerisation of the plastic material. A gaseous hydrocarbon stream 2 containing pyrolysed plastic material is then obtained as the top product of a column 12. The gaseous hydrocarbon stream 2 is subsequently brought into contact with a composition 3 containing at least one nitrogen compound in order to obtain a gaseous mixture 4. The temperature of the gaseous hydrocarbon stream 2 when brought into contact with the composition 3 is preferably at least 300° C. The composition 3 can be metered in liquid form into the hot hydrocarbon stream 2, wherein the composition 3 evaporates rapidly, which enables good mixing with the hydrocarbon stream 2, in particular if the composition 3 is an aqueous composition. In the gaseous mixture 4 thus obtained, nucleophilic substitution reactions take place in which the nitrogen compounds contained in composition 3 nucleophilically attack the organic chlorine compounds originating from the PVC and thus the organically bound chlorine is converted into chloride ions. In the embodiment shown, a gas stream 13 can be segregated from the gaseous mixture 4 in a further column 14. In the embodiment shown, the material stream 15 obtained therefrom is mixed with an aqueous washing solution 6 in a mixing zone of a mixer-settler 16, wherein chloride ions pass into the aqueous phase. Subsequently, the purified oil phase is segregated from the aqueous phase in a settling zone of the mixer-settler 16. The aqueous phase is removed as wastewater stream 17 and the oil phase is obtained as hydrocarbon product 5.

EXAMPLE 1: PRODUCTION OF SYNTHETIC CRUDE OIL WITH REDUCED CONTENT OF ORGANICALLY BOUND HALOGEN

In order to test the reduction of organically bound chlorine and bromine with the method according to the invention, test runs for producing synthetic crude oil were carried out essentially as shown in FIG. 1. The starting material used was plastic mixtures to which 0.5 wt % or 1 wt % of PVC had been added and which contained between 5 and 250 ppm of bromine.

The plastic mixtures were extruded as described in FIG. 1 and cracked at a temperature between 400° C. and 440° C. A gaseous hydrocarbon stream was segregated as the top product of a column downstream of the depolymerisation reactor. Immediately after the column, an amine composition was metered into the hydrocarbon stream. The temperature of the hydrocarbon stream during metering in was 370° C. A solution of 10 wt % ethanolamine in water was used as the amine composition. The amount metered in of the amine composition was 3 kg/h at a feed rate of 80 kg/h. The product obtained was washed and the content of organically bound chlorine and bromine in the organic phase was determined.

The following concentrations of organically bound chlorine and bromine were obtained in the product:

- 0.5 wt % PVC in the feed: 16 ppm organically bound chlorine, 0 ppm organically bound bromine;
- 1 wt % PVC in the feed: 58 ppm organically bound chlorine, 0 ppm organically bound bromine;
- Comparative experiments without dosing in the amine composition: 200-2,000 ppm organically bound chlorine; up to 250 ppm organically bound bromine.

In summary, the metering in of nitrogen compounds provided according to the invention thus led to a considerable reduction in the content of organically bound halogen in the product.

EXAMPLE 2: COMPARATIVE EXPERIMENTS WITH DIFFERENT NITROGEN COMPOUNDS

In order to investigate the influence of the choice of nitrogen compound, comparative experiments were carried out with different nitrogen compounds. As a feedstock, a synthetic crude oil contaminated with halocarbons and with an organochlorine content of 58 ppm was used. The feedstock was placed in a pressure vessel with the respective amine (2 wt %) at room temperature and heated to 130° C. for 30 min. After cooling, the organic phase was washed with water and analysed.

The following results were achieved with the respective nitrogen compounds:

| Nitrogen compound | Degree of substitution | Boiling point | Result (organically bound chlorine [ppm]) |
|---|---|---|---|
| Ammonia | — | −33° C. | 52.0 |
| Ethanolamine | primary | 170° C. | 32.1 |
| Dimethylamine | secondary | 7° C. | 22.0 |
| Diethylamine | secondary | 56° C. | 27.4 |
| Dibutylamine | secondary | 159° C. | 28.3 |
| Morpholine | secondary | 129° C. | 24.6 |
| Diethanolamine | secondary | 269° C. | 43.0 |
| Triethylamine | tertiary | 89° C. | 54.0 |

As can be seen from the table above, the best results were achieved with secondary amines with a boiling point of less than 200° C. (dimethylamine, diethylamine, dibutylamine, morpholine; all below 30 ppm of organically bound chlorine in the product). These nitrogen compounds proved to be advantageous both over primary (ethanolamine) and tertiary (triethylamine) amines as well as ammonia, and over secondary amines with a higher boiling point (diethanolamine).

EXAMPLE 3: COMPARATIVE EXPERIMENTS WITH DIFFERENT NITROGEN COMPOUNDS AT HIGHER TEMPERATURES

In order to investigate the effect of the different nitrogen compounds at higher temperatures, the experiments described in example 2 were carried out at a higher temperature. As a feedstock, in turn, a synthetic crude oil contaminated with halocarbons and with an organochlorine content of 58 ppm was used. The feedstock was placed in a pressure vessel with the respective amine (2 wt %) at room temperature and heated to 300° C. for 10 min. After cooling, the organic phase was washed with water and analysed.

| Nitrogen compound | Degree of substitution | Boiling point | Result (organically bound chlorine [ppm]) |
|---|---|---|---|
| Ethanolamine | primary | 170° C. | 15 |
| Dimethylamine | secondary | 7° C. | 2 |
| Morpholine | secondary | 129° C. | 4 |
| Diethanolamine | secondary | 269° C. | 8 |

As can be seen from the table above, the higher temperature led to an even more significantly increased reduction of organically bound chlorine. Again, the use of secondary amines with a boiling point of less than 200° C. (dimethylamine, morpholine) proved to be advantageous both over a primary amine (ethanolamine) and over a secondary amine with a higher boiling point (diethanolamine).

The invention claimed is:

1. A method for producing a hydrocarbon product from a hydrocarbon mixture containing at least 1 ppm of organically bound halogen, the method comprising:

providing the hydrocarbon mixture containing at least 1 ppm of organically bound halogen;

heating the hydrocarbon mixture in order to obtain a gaseous hydrocarbon stream;

bringing the gaseous hydrocarbon stream into contact with a composition containing at least one nucleophilic nitrogen compound in order to obtain a gaseous mixture, as a result of which organically bound halogen is converted into halide ions, wherein a mass ratio between the gaseous hydrocarbon stream and the composition containing the at least one nucleophilic nitrogen compound is at least 5:1, wherein a temperature of the gaseous hydrocarbon stream when brought into contact is at least 150° C. and wherein a temperature of the obtained gaseous mixture is at least 150° C.; and separating the halide ions in order to obtain the hydrocarbon product.

2. The method according to claim 1, wherein the at least one nucleophilic nitrogen compound is selected from the group consisting of primary amines, secondary amines, tertiary amines, ammonia and hydrazine.

3. The method according to claim 1, wherein the hydrocarbon mixture contains at least 0.2% wt % of polyvinyl chloride (PVC).

4. The method according to claim 1, wherein the hydrocarbon mixture contains bromine-containing flame retardants, preferably polybrominated diphenyl ethers and/or polybrominated biphenyls, more preferably decabromodiphenyl ether (DecaBDE), tetrabromobisphenol A (TBBPA) and/or hexabromocyclododecane (HBCD).

5. The method according to claim 1, wherein the hydrocarbon mixture is a hydrocarbon mixture obtained from plastic material, in particular waste plastic.

6. The method according to claim 1, wherein the hydrocarbon mixture is a crude oil, preferably a synthetic crude oil, in particular a pyrolysis oil.

7. The method according to claim 1, wherein the heating of the hydrocarbon mixture takes place in the course of a pyrolysis process, a hydrogenation process, or a distillation process.

8. The method according to claim 1, wherein the temperature of the gaseous hydrocarbon stream when brought into contact with the composition containing the at least one nucleophilic nitrogen compound is at least 200° C.

9. The method according to claim 1, wherein the composition containing the at least one nucleophilic nitrogen compound is an aqueous composition.

10. The method according to claim 1, wherein a concentration of nucleophilic nitrogen compounds in the composition is between 10 and 50 wt %.

11. The method according to claim 1, wherein the mass ratio between the gaseous hydrocarbon stream and the composition containing the at least one nucleophilic nitrogen compound is between 15:1 and 50:1.

12. The method according to claim 1, wherein the at least one nucleophilic nitrogen compound is a secondary amine having a boiling point of less than 200° C.

13. The method according to claim 1, wherein the at least one nucleophilic nitrogen compound is selected from the group consisting of ammonia, ethanolamine, 3-methoxypropylamine, dimethylamine, diethylamine, dibutylamine, morpholine, diethanolamine, and/or triethylamine; preferably dimethylamine, diethylamine, dibutylamine, and/or morpholine.

14. The method according to claim 1, wherein separating the halide ions takes place by washing with an aqueous washing solution, preferably wherein the aqueous washing solution is basic.

15. The method according to claim 1, wherein separating the halide ions takes place by distillation.

16. The method according to claim 1, wherein the hydrocarbon product contains less than 200 mg/kg of organically bound halogen.

* * * * *